US007170446B1

(12) United States Patent
West et al.

(10) Patent No.: US 7,170,446 B1
(45) Date of Patent: Jan. 30, 2007

(54) PHASED ARRAY ANTENNA INTERCONNECT HAVING SUBSTRATE SLAT STRUCTURES

(75) Inventors: James B. West, Cedar Rapids, IA (US); John C. Mather, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 120 days.

(21) Appl. No.: 10/949,842

(22) Filed: Sep. 24, 2004

(51) Int. Cl.
*H01P 1/18* (2006.01)
*H01Q 3/30* (2006.01)

(52) U.S. Cl. ..... 342/372; 333/164; 343/767

(58) Field of Classification Search ..... 333/156, 333/161; 342/371, 372, 375; 343/767, 853
See application file for complete search history.

(56) References Cited

U.S. PATENT DOCUMENTS 6,650,291 B1 * 11/2003 West et al. ..... 342/371
6,822,617 B1 * 11/2004 Mather et al. ..... 343/797
6,950,062 B1 * 9/2005 Mather et al. ..... 342/372

OTHER PUBLICATIONS

Holter, H. Chio, T., Schaubert, D.H., *Experimental Results of 144-Element Dual-Polarized Endfire Tapered-Stop Phased Arrays:* IEEE Transactions on Antennas and Propagation, vol. 48, No. 11, Nov. 2000, pp. 1707-1718.

C. B. Wyllie, G. M. Lewis, R. A. Lewis, *Dual-Polar Vivaldi Antennas For Phased Arrays With Wide-Angle Scanning,* 11th International Conference on Antennas and Propagation, Apr. 17-20, 2001, Conference Publication No. 480 © IEE 2001, pp. 672-676.

* cited by examiner

*Primary Examiner*—Benny T. Lee
(74) *Attorney, Agent, or Firm*—Nathan O. Jensen; Kyle Eppele

(57) ABSTRACT

A phased array antenna is provided having a plurality of phase shifter devices for phase shifting and beam steering a radiated beam of the phased array antenna. The plurality of phase shifter devices are interconnected with an interconnect structure comprising a plurality of linear array substrate slats. Each linear array substrate slat includes a plurality of radiating elements formed using first and second metal layers of the substrate slat, a plurality of phase shifter devices and a common RF feed conductor for the plurality of radiating elements. The common RF feed conductor is formed on a third metal layer of the substrate slat that is disposed between the first and second metal layers. The common RF feed conductor is configured to include a single location for electrical connections to receive RF signals for the plurality of radiating elements. The phased array antenna also includes bias/control conductors applied to selected areas of the third metal layer, a fourth metal layer applied over the second metal layer and a shielding metal layer applied on the fourth metal layer. The bias/control conductors are configured to include a single location for electrical connections to receive bias voltages and control signals. The fourth metal layer includes circuit connections from the bias/control circuitry to the plurality of phase shifter devices. Each phase shifter device is attached to a radiating element via a mounting location on the shielding metal layer. Accordingly, a phased array antenna interconnect structure is provided that reduces the number of electrical connections required to provide RF signals and bias/control signals to multiple radiating elements and phase shifters, respectively, of the phased array antenna and provides a cost effective phased array antenna architecture that has a single locus of electrical connection for RF and bias control signals embedded in a multi-layer linear array or slat substrate of the phased array antenna.

20 Claims, 6 Drawing Sheets

PHASED ARRAY ANTENNA INTERCONNECT HAVING SUBSTRATE SLAT STRUCTURES

CROSS-REFERENCE TO RELATED PATENT APPLICATIONS

The present application is related to application Ser. No. 10/273,872, filed Oct. 18, 2002, now U.S. Pat. No. 6,822,617 entitled "A Construction Approach for an EMXT-Based Phased Array Antenna," and to application Ser. No. 10/273,459, filed Oct. 18, 2002, now U.S. Pat. No. 6,950,062, entitled "A Method and Structure for Phased Array Antenna Interconnect," both of which applications are herein incorporated by reference in their entirety. All applications are assigned to the assignee of the present application.

FIELD OF THE INVENTION

The present invention relates generally to the field of antennas, phased array antennas and in particular to a method and structure for an interconnect for broad band printed end-fire and dipole phased array antenna elements.

BACKGROUND OF THE INVENTION

Many military and commercial applications of satellite communication (SATCOM) and radar systems require rapid electronic beam scanning, often on the order of tens of microseconds or less, as well as continuous connectivity of communications for on-the-move vehicles. In a military scenario, it is crucial to maintain near total situational awareness. For example, a battle brigade needs reliable satellite communications in a moving platform environment. Maintaining connectivity is critical to advanced systems such as the Future Combat Systems (FCS) communication and data link system. In an FCS system, for example, it is desirable to simultaneously maintain concurrent surface-to-surface, surface-to-air, and surface-to satellite modes of operation. Radical vehicular platform movement, e.g., high performance fighter aircraft "dog fighting" maneuvers, further complicates the need for rapid beam scanning. The requirements of millimeter wave radar systems include imaging, target missile and armament seeking and guidance and fire control. Millimeter wave systems are also becoming increasingly important for commercial broadband connectivity SATCOM systems, including wireless Internet, Direct Broadcast System (DBS) satellite television systems and others. In addition, data link functions are required for current and next generation advanced military systems.

Phased array antennas offer significant system level performance enhancements for both military and commercial applications of advanced communications, data link, radar and SATCOM systems. A phased array antenna is a beam focusing antenna in which the relative phases of the respective signals feeding the antennas are varied such that the effective radiation pattern of the phased array is reinforced in a desired direction and suppressed in undesired directions. The relative amplitudes of constructive and deconstructive interference effects among the signals radiated by the individual elements determine the effective radiation pattern of the phased array. Phased array antennas provide rapid electronic radiation beam scanning as required by the various systems discussed above. The ability to rapidly scan the radiation pattern of a phased array antenna may allow for multifunction/multi-beam/multi-target, LPI/LPD (low probability of intercept and low probability of detection) and A/J (anti-jam) capabilities. Polarization matched satellite tracking and broad band, multi-function phased array architectures may also enable simultaneous reception of satellite TV and other data links.

Despite the benefits of phased array antennas described above, phased array antennas are often only integrated into the most sophisticated and expensive military and commercial applications due to prohibitively high costs. Traditional passive phased array antennas require tight mechanical tolerances, low loss RF feed manifolds, and an extremely high control and bias interconnect count. A phase shifter may be included in a radiating element to provide the required variation in electrical phase for the radiating element. A phased array antenna may include tens of thousands of radiation elements, phase shifters, etc. Accordingly, a large number of control lines may be required to provide the proper control signals, bias and chassis ground for the radiation element, phase shifters, etc. of a phased array antenna. In addition, separate electrical connections are typically provided for each radiating element and phase shifter to connect to signal sources (e.g., to receive RF signals and bias/control signals, respectively). For example, a typical 5-bit digital phase shifter requires positive and negative bias voltages, chassis ground, and five control lines, for a total conductor count of 8 lines for each element of a phased array antenna system. In this example, a 10,000 element phased array antenna system would require 80,000 non-RF control lines. Typically, each of these control lines must be environmentally robust, have high EMI interference immunity, and must be unobtrusive to the natural RF radiation of the phased array. In addition, a Solid State Phased Array (SSPA) is further complicated by the fact that high bias currents often dictate liquid cooling to maintain power amplifier transistor-junction temperatures at reliable levels to ensure adequate system operational lifetimes.

Accordingly, there is a need for a phased array antenna structure and method for interconnecting elements of the phased array antenna that reduces the number of electrical connections required to provide signals to multiple radiating elements and phase shifters of the phased array antenna. There is also a need for a cost effective phased array antenna architecture that has a single locus of electrical connection for RF signals and bias/control signals embedded in the multilayer linear array (or slat) interconnect substrates of the phased array antenna.

SUMMARY OF THE INVENTION

In accordance with one embodiment, a phased array antenna has a plurality of phase shifter devices for phase shifting and beam steering a radiated beam of the phased array antenna, the plurality of phase shifter devices interconnected with an interconnect structure comprising a plurality of linear array substrate slats. Each linear array substrate slat includes a plurality of radiating elements formed using first and second metal layers of the substrate slat, a plurality of phase shifter devices, a common RF feed conductor for the plurality of radiating elements, the common RF feed conductor formed on a third metal layer of the substrate slat and configured to include a single location for electrical connections to receive RF signals for the plurality of radiating elements, the third metal layer disposed between the first and second metal layers, bias/control conductors applied to selected areas of the third metal layer and configured to include a single location for electrical connections to receive bias voltages and control signals for the plurality of phase shifter devices, a fourth metal layer applied over the second metal layer, the fourth metal layer including circuit connections from the bias/control conductors to the plurality of phase shifter devices and a shielding metal layer applied on the fourth metal layer. Each phase shifter device is attached to a radiating element via a mounting location on the shielding metal layer.

In accordance with another embodiment, a method for fabricating a linear array substrate slat for a phased array antenna having a plurality of phase shifter devices for phase shifting and beam steering a radiated beam of the phased array antenna, the plurality of phase shifter devices interconnected with an interconnect structure comprising a plurality of the linear array substrate slats, the method including forming a plurality of radiating elements using first and second metal layers of the substrate slat, applying a common RF feed conductor for the plurality of radiating elements, the common RF feed conductor formed on a third metal layer of the substrate slat and configured to include a single location for electrical connections to receive RF signals for the plurality of radiating elements, the third metal layer disposed between the first and second metal layers, applying bias/control conductors to selected areas of the third metal layer, the bias/control conductors configured to include a single location for electrical connections to receive bias voltage and control signals for the plurality of phase shifter devices, applying a fourth metal layer over the second metal layer, the fourth metal layer including circuit connections from the bias/control conductors to the plurality of phase shifter devices, applying a shielding metal layer on the fourth metal layer, and attaching a plurality of phase shifter devices, each phase shifter device attached to a radiating element via a mounting location on the shielding metal layer.

DETAILED DESCRIPTION OF THE PREFERRED EMBODIMENTS

A phased array antenna interconnect structure is provided that reduces the number of electrical connections required to provide RF signals and bias/control signals to multiple radiating elements and phase shifters, respectively, of the phased array antenna and provides a cost effective phased array antenna architecture that has a single locus of electrical connection for RF signals and bias/control signals embedded in a multi-layer linear array or slat substrate of the phased array antenna.

Figure 1:
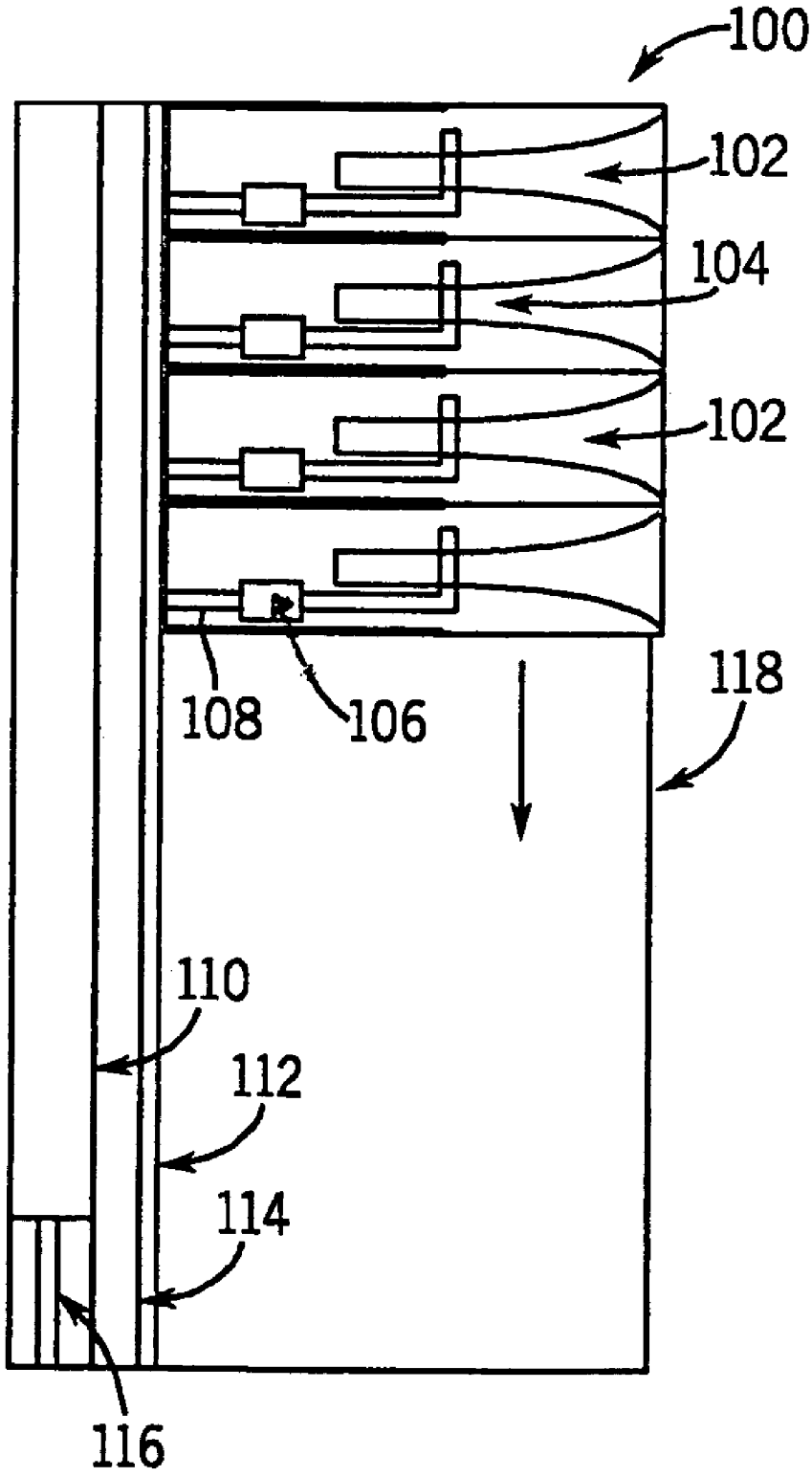
FIG. 1 illustrates a linear array (or slat) having multiple radiating elements with integral phase shifters in accordance with an embodiment.

A phased array antenna may be created using unit cells comprising a radiating element. A linear array or slat may be formed by placing multiple radiating elements on an interconnect substrate (e.g., a common printed wiring board (PWB) substrate). FIG. 1 illustrates a linear array (or slat) having multiple radiating elements with integral phase shifters in accordance with an embodiment. Linear array (or slat) 100 comprises multiple radiating elements 102 on a common substrate 118. In FIG. 1, exemplary end-fire radiating elements 102 are shown. Various radiating elements may be used such as tapered slot end-fire radiating elements, printed notch end-fire radiating elements (e.g., Vivaldi, exponential, etc.), Yagi-Uda end-fire radiating elements, dipole radiating elements, Log Periodic Dipole Array (LDPA) radiating elements, "zig zag" traveling wave radiating elements, monopole radiating elements, dielectric rod radiating elements, etc. Preferably, substrate 118 is a printed wiring board (PWB) fabricated using materials and technologies that maximize RF performance. Phase shifting capability may be integrated into linear array 100 by appropriately mounting a phase shifter device 106 and incorporating RF feed manifold 110, RF feed manifold I/O 116 and bias/control circuitry 114 for each phase shifter 106 and each radiating element 102 unit cell. An interconnect assembly is required to provide the proper RF signals, control signals, bias and chassis ground to each individual radiating element 102 and phase shifter 106 of the linear array 100. Phase shifting device 106 may be, for example, a phase shifter, a true time delay (TTD) device or a T/R (transmit/receive) module with an integrated phase shifter. Phase shifting devices 106 are used to phase shift and beam steer a radiated beam of the phased array antenna. Control signals may be provided to each phase shifter from, for example, a beam steering computer (not shown) and bias voltages may be provided to each phase shifter from an appropriate power source.

Each radiating element 102 of linear array 100 also includes a radiation element to transmission line transition 104 and an RF transmission line to feed manifold transition 108. In FIG. 1, linear array 100 includes an RF feed manifold 110 (e.g., a microstrip feed manifold, stripline feed manifold, etc.) and an RF feed manifold input/output (I/O) 116. RF feed manifold 110 is coupled to each radiating element 102 through a phase shifter 106 and may include an RF printed transmission line feed for the entire linear array 100. RF feed manifold I/O 116 acts as a single location for electrical connections to receive the RF signals required for the entire linear array 100. RF feed manifold I/O 116 may be coupled to an RF source to receive RF signals. In addition, bias/control lines 114 are coupled to each phase shifting device 106 of the linear array 100 and are configured to include a single location for electrical connections (or inputs) to receive the bias/control signals (e.g., control signals, bias voltages, etc.) required for the phase shifting devices 106. Bias/control lines may be, for example, metallic conductor lines. The source of control signals may be, for example, a beam steering computer (BSC) and the source of bias voltages is an appropriate power source. In alternative embodiments, linear array 100 may be configured to support an optical interconnect (i.e., RF-to-optical-to-RF conversions). For example, linear array 100 may be constructed to include an optical phase shifter/BSC interconnect 112.

Linear array 100 is created with integral phase shifter components, integral RF feed manifold 110, RF feed manifold I/O 116 and integral bias/control circuitry 114 in a multi-layer interconnect substrate, Linear array (or slat) 100 is constructed so that the RF circuitry (e.g., RE feed manifold 110 and RF feed manifold I/O 116) and the bias/control conductors 114 are embedded within the linear array structure. As mentioned above, the linear array assembly 100 shown in FIG. 1 advantageously is configured to include a single locus (or area) for electrical connections for the required RF feed manifold I/O (i.e., RF feed manifold I/O 116) and bias/control circuitry 114 inputs embedded in the interconnect substrate 118. Linear array 100 is created using a circuitized interconnect assembly approach to provide the conductor traces for delivering electrical signals to each radiating element 102 (e.g., delivering RF signals) and to each phase shifting device 106 (e.g., delivering bias/control signals) in the linear array 100. A circuitized interconnect assembly may be used to create an RF non-intrusive, EMI immune, compact and high density interconnect scheme for the multiple bias, ground and control lines required for the plurality of radiating elements 102 and phase shifters 106 contained within or on linear array 100. The circuitized interconnect approach may also be used to create the conductors/circuitry required for the RF feed manifold 110 and RF feed manifold I/O 116 in linear array 100. A circuitized interconnect assembly and method is described generally in U.S. patent application Ser. No. 10/273,459 entitled, "A Method and Structure for Phased Array Antenna Interconnect," herein incorporated by reference in its entirety, issued as U.S. Pat. No. 6,950,062. As described in the referenced application, a circuitized interconnect approach utilizes a fine-pitch high density circuitry in a thin, self-shielding multi-layer printed wiring assembly. In this approach, the thickness dimension of an array aperture wall (parallel to bore sight axis) is used to provide the surface area and volume required to implement all of the conductive traces for phase shifter bias, ground, and control lines. As mentioned above, in accordance with the embodiment shown in FIGS. 1, 2A and 2B of the present application, a circuitized interconnect approach is also used to implement the RF feed circuitry as well as the conductive traces for the phase shifter bias, ground and control lines.

To fabricate the circuitry of linear array 100, preferably, printed wiring board (PWB) circuit materials and fabrication processes and methods are utilized. The following discussion of FIGS. 1, 2A, 2B, 3A, 3B, 4, 5, 6 is made in terms of printed wiring board technologies. Alternatively, thin film technologies may be used to fabricate the circuitry of linear array 100. In a thin film approach, alternating layers of thin film dielectric material(s) and metal(s) are deposited and configured (imaged) in sequence. Applicable well-established deposition processes include spinning, curtain coating, vacuum deposition, electrodeposition, and/or electroless deposition. Configuring and imaging processes may include machining (including laser), etching, or the like to remove unwanted material; or deposition through a contact mask so the deposited material reaches the substrate 118 only in the desired locations. For some dielectric material types, photosensitive versions are available to facilitate imaging.

As mentioned above, a linear array (or slat) 100 includes an RF line feed manifold 110, for example, a RF printed transmission feed manifold or a stripline feed manifold, configured to include a single location at RF feed manifold I/O 116 for electrical connections to RF signal inputs. In addition, linear array 100 includes a single location for electrical connections to bias and control inputs (e.g., from an appropriate power source and a beam steering computer, respectively). As mentioned, a circuitized interconnect approach is used to create the conductors/circuitry required for RF feed manifold 110, the RF feed manifold I/O 116 and the bias/control lines 114 so that such circuitry is embedded in the substrate or printed wiring board 118. Regions of printed wiring board 118 are partitioned for the RF feed network including RF feed manifold 110 and RF feed manifold I/O 116 (e.g., microstrip, stripline, slot line or coplanar waveguide fed networks) and control and bias lines 114. In one embodiment, a suspended stripline (i.e., an "air" stripline) for the RE feed network may also be accommodated by sandwiching the circuit card between "hogged out" chassis elements with low-loss metallic surface finishes to minimize feed manifold insertion loss.

Figure 2A:
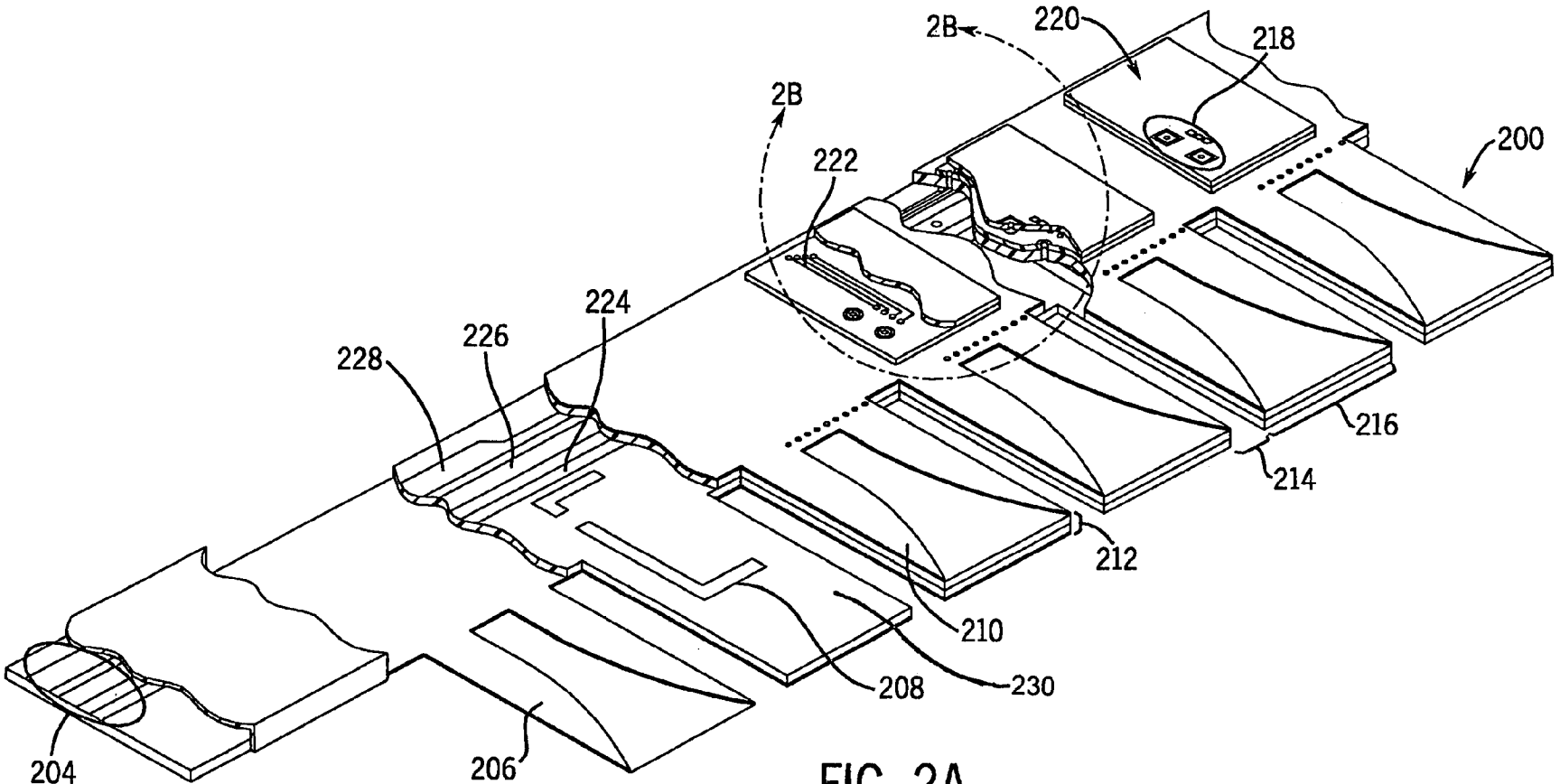
FIG. 2A is a cutaway view of a linear array (or slat) incorporating phase shifting capability and a single electrical connection location for RF signals and bias/control signals in accordance with an embodiment.

FIG. 2A is a cutaway diagram of a linear array (or slat) incorporating phase shifting capability and a single location 204 for RF and bias/control signal inputs in accordance with an embodiment. Each radiating element 216 in linear array 200 is constructed using an interconnect substrate and separated from each other by a gap 214. Preferably, the interconnect substrate is a three metal layer printed wiring board substrate 212 (i.e., metal layers 210, 230, 206) having the appropriate dielectric and conductor properties and geometries. Metal layer (210) and metal layer (206) (i.e., the bottom metal layer) are at ground potential. Metal layer (210) and metal layer (206) are imaged (or configured) to form the appropriate geometry for the type of radiating element 216 being used (e.g., a notch, etc.). Metal layer (230) is disposed between metal layer 210 and metal layer 206. Metal layer (230) is imaged (or configured) to form various conductors including a common RF feed conductor 224 (e.g., an RF stripline feed) for the entire linear array 200, an individual feed 208 for each radiating element 216, a ground conductor 226 and all bias/control lines 228 required for each phase shifter (not shown) in the linear array 200. Bias/control lines 228 may include a plurality of conducting lines as shown in FIG. 2B.

Two additional metal and dielectric layers, metal layer (222) and metal layer (220) are used to connect the bias/control signal traces 228 to each phase shifter (not shown). Each radiating element unit cell 216 also includes a mounting location 218 formed on metal layer (220). Mounting location 218 is used to mount a phase shifter device and coupled the phase shifter device to the bias/control lines 228. Metal layer (222) is used to connect the bias/control signal traces 228 to each phase shifter device via the mounting location 218. Metal layer (220) is grounded to metal layer (210) and shields the metal layer (222) signal traces (e.g., bias/control lines 228, ground conductor 224, RF feed 224, etc) from electromagnetic (EM) radiation. Metal layer (220) and metal layer (222) and their associated dielectric layers may be viewed as isolated "islands of circuitry." Metal layer (220) and metal layer (222) and their associated circuitry are preferably created using conventional RF printed wiring board (PWB) substrates and processing techniques, for example, by sequential addition of imaged printed wiring laminate to the initial three metal layer substrate 212 (metal layers 210, 230, and 206). Alternatively, multilayer thin film methods may be used to create metal layer 220, metal layer 222 and their associated circuitry.

Figure 2B:
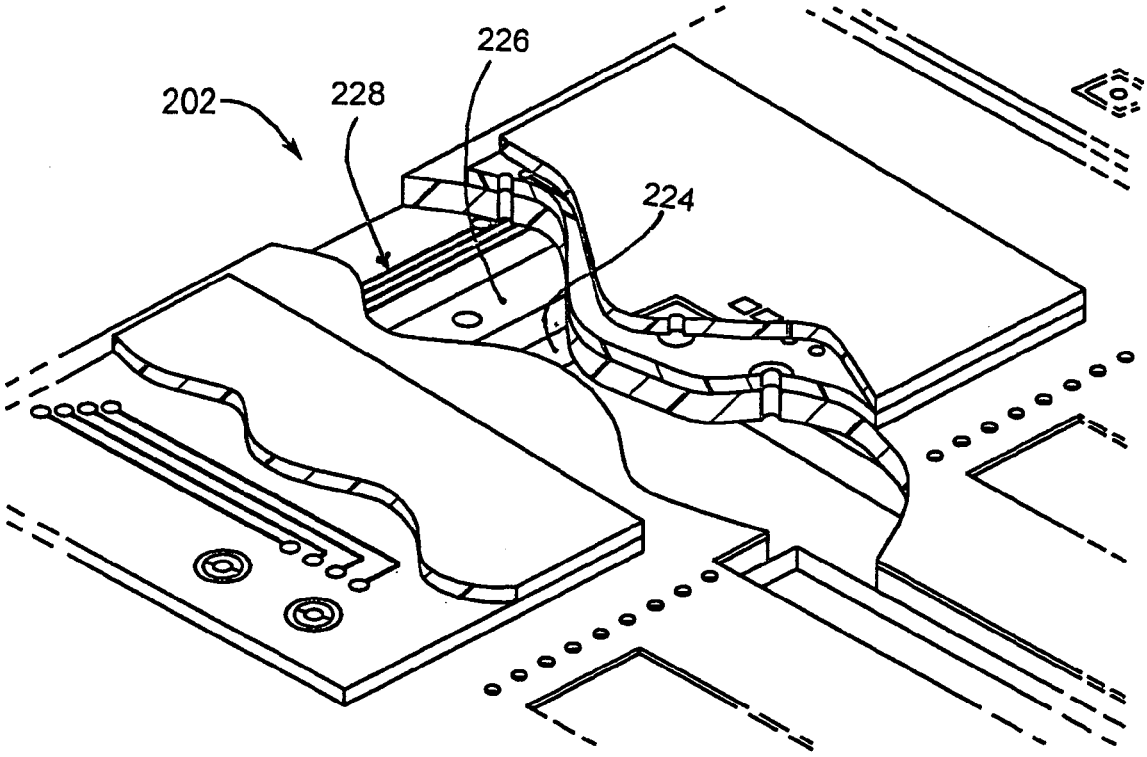
FIG. 2B is a detail cutaway view of a portion of the linear array of FIG. 2A in accordance with an embodiment.

A detailed cutaway 202 view of metal layers 220, 222, 210, and 230 of linear array (or slat) 200 is shown in FIG. 2B which shows the use of blind vias to achieve the interconnect (which includes bias/control lines 228, ground conductor 226 and RF feed conductor 224) for the radiating element unit cells 216. Returning to FIG. 2A, a mounting location 218 for a phase shifter device is provided on each radiating element 216. A slot 214 between each radiating unit cell 216 may optionally be provided to facilitate the use of linear array 200 to create a two-dimensional phased array antenna as discussed further below. Various methods and processes known in the art may be used for mechanical attachment and electrical connection of a phase shifter device to a radiating element unit cell 216 at a mounting location 218. For example, in one embodiment, solder attachment to the may be used to secure the phase shifter device (not shown) and accomplish the required ground and bias connections. Underfill of the phase shifter device (not shown) may be used to enhance the attachment ruggedness. In another embodiment, wirebonds to the phase shifter device topside for ground and bias connections may be made and a bonding method such as adhesive or metrical bonding may be used to attach the phase shifter device backside to the substrate. As understood by people of skill in the art, the terms "topside" and "backside" generally refer to the first and last layers on a semiconductor substrate; one being on top of a stack of layers and the other being on a bottom of the stack of layers.

Figure 3A:
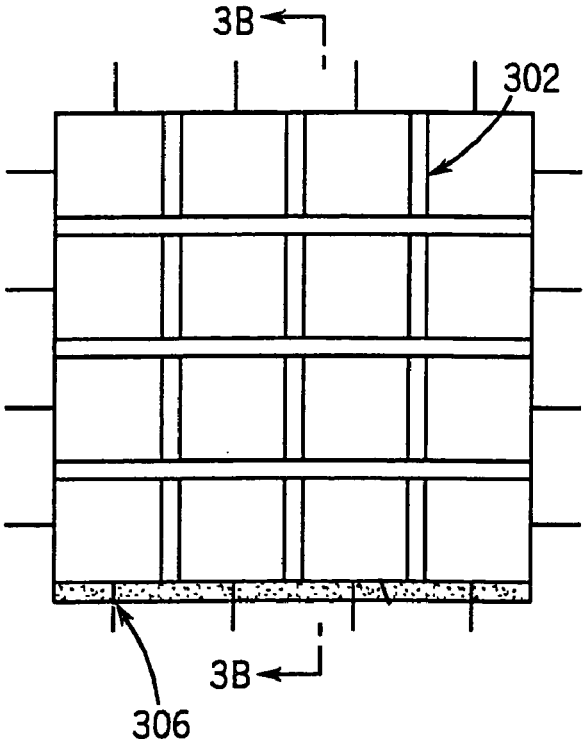
FIG. 3A illustrates a front view of a two-dimensional phased array structure using a constrained feed manifold in accordance with an embodiment.
Figure 3B:
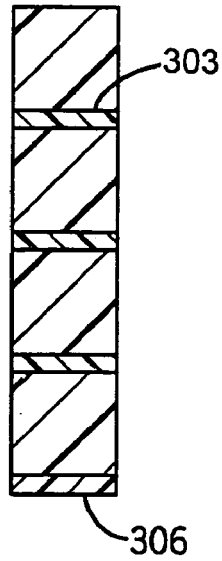
FIG. 3B illustrates an edge view of the two-dimensional phased array structure using a constrained feed manifold of FIG. 3A in accordance with an embodiment.

Multiple linear arrays or slats may be used as a building block to create a two-dimensional phased array antenna. A collection of vertical linear arrays may be appropriately spaced along a horizontal plane to realize a two-dimensional phase array. A two dimensional phased array constructed using a circuitized interconnect having a single location of electrical connections may advantageously be fed using various methods, for example: 1) a constrained transmission line based feed manifold located on a perimeter of the two-dimensional phased array, 2) a constrained printed wiring board (PWB) feed located directly behind, and perpendicular to, the slats of the two-dimensional array and 3) a space feed. FIGS. 3A and 3B illustrate a front and side view, respectively, of a two-dimensional phased array structure using a perimeter constrained feed in accordance with an embodiment. In the perimeter constrained feed embodiment, shown in FIG. 3A, printed transmission lines are embedded into linear arrays (or slats) 302, as described above with respect to FIGS. 1, 2A and 2B. In FIG. 3A, active vertical slats 302 are use. As shown in FIG. 3B, active and/or passive horizontal slats 303 are also included in the phased array structure. The vertical slats 302 and horizontal slats 303 may be formed in an "egg-crate" configuration as discussed further below. Returning to FIGS. 3A and 3B, the linear arrays 302 include radiating elements (not shown) that may be phase shifted relative to each other by means of a horizontal circuitized/printed feed manifold assembly 306 utilizing phase shifting or True Time Delay (TTD) devices as described above with respect to FIGS. 1, 2A, and 2B. In FIGS. 3A and 3B, an end-fed linear array is shown. In alternative embodiments, a printed wiring board (PWB) feed located directed behind, and perpendicular to, slats 302, 303 can be used.

Figure 4:
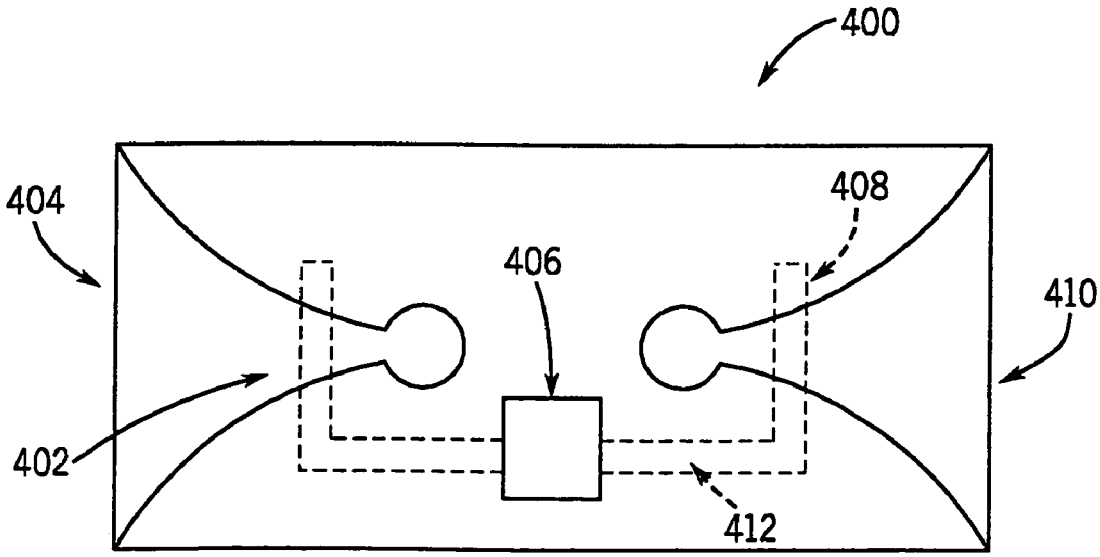
FIG. 4 is a diagram of a transmit/receive element pair comprising back to back end fire notch radiating elements for a space fed phased array in accordance with an embodiment.

As mentioned above, a two dimensional array of FIGS. 1, 2A, 2B may also be fed using a space feed to provide RF signals required by the phased array. In a space feed embodiment, the RF stripline feed manifold 110 and RF feed manifold I/O 116 of the linear array (or slat) shown in FIGS. 1, 2A and 2B are removed and RF signals are provided by a space feed (e.g., an RF source coupled to a feed horn). In addition, each radiating element 102 of the linear array is replaced with a radiating element pair 400 as shown in FIG. 4 and discussed below. Bias/control lines 114 are provided in a slat as shown in FIGS. 1, 2A and 2B and include a single locus of electrical connection for bias/control signals. FIG. 4 illustrates a single transmit/receive (primary/secondary) element pair 400 comprising back-to-back end fire notch radiating elements for a space fed array in accordance with an embodiment. Multiple element pairs 400 may be formed in an "egg crate" configuration that comprises an input or receive end fire array having multiple receive (or secondary) radiating elements 410 and an output or transmit end fire array having multiple transmit (or primary) radiating elements 404. A receive radiating element 410 in each element pair 400 receives an input signal from the space feed (e.g., an RF source coupled to a feed horn (not shown)). Transmission lines (e.g., transmission line-to-antenna transition 402, transmission line tuning stub 408, transmission line 412 which may be optionally configured to provide a desired delay) within each element 400 and a phase shifter 406 (e.g., a phase shifter or TTD or T/R device with an embedded phase shifter) collimates the incoming wavefront and steers the antenna beam.

If different frequencies are required, then the amount of spherical wave front correction to achieve collimation will be a function of frequency. The typical bandwidth of a space fed phased array scanned 60° off boresight is two times the aperture beam width. This bandwidth may be greater for scanned arrays. Several techniques can be used to compensate for this frequency dependence, including, 1) feed antennas that have a phase center that moves as a function of frequency, and 2) frequency sensitive delay networks within the lens assembly.

Arbitrary linear, circular and dual linear polarization architectures for a two dimensional phased array may be achieved using either a perimeter constrained feed embodiment as shown in FIGS. 3A and 3B, a space feed embodiment as shown in FIG. 4 or a perpendicular constrained feed (i.e., a PWB feed located behind and perpendicular to the slats of the two dimensional phased array). With respect to a constrained feed embodiment as shown in FIGS. 3A and 3B, dual linear polarization may be realized by adding a second, vertical feed manifold (not shown) to feed the horizontal slats which would be active for this embodiment. Arbitrary linear polarization (LP), right hand circular polarization (RHCP), and left hand circular polarization may be generated by the appropriate vector combination of the vertical and horizontal feed manifold signals. With respect to a space feed embodiment as described above with respect to FIG. 4, a dual polarized waveguide horn (not shown) with an orthomode transducer (OMT) may be used to simultaneously generate two senses of linear polarization at the same frequency.

Figure 5:
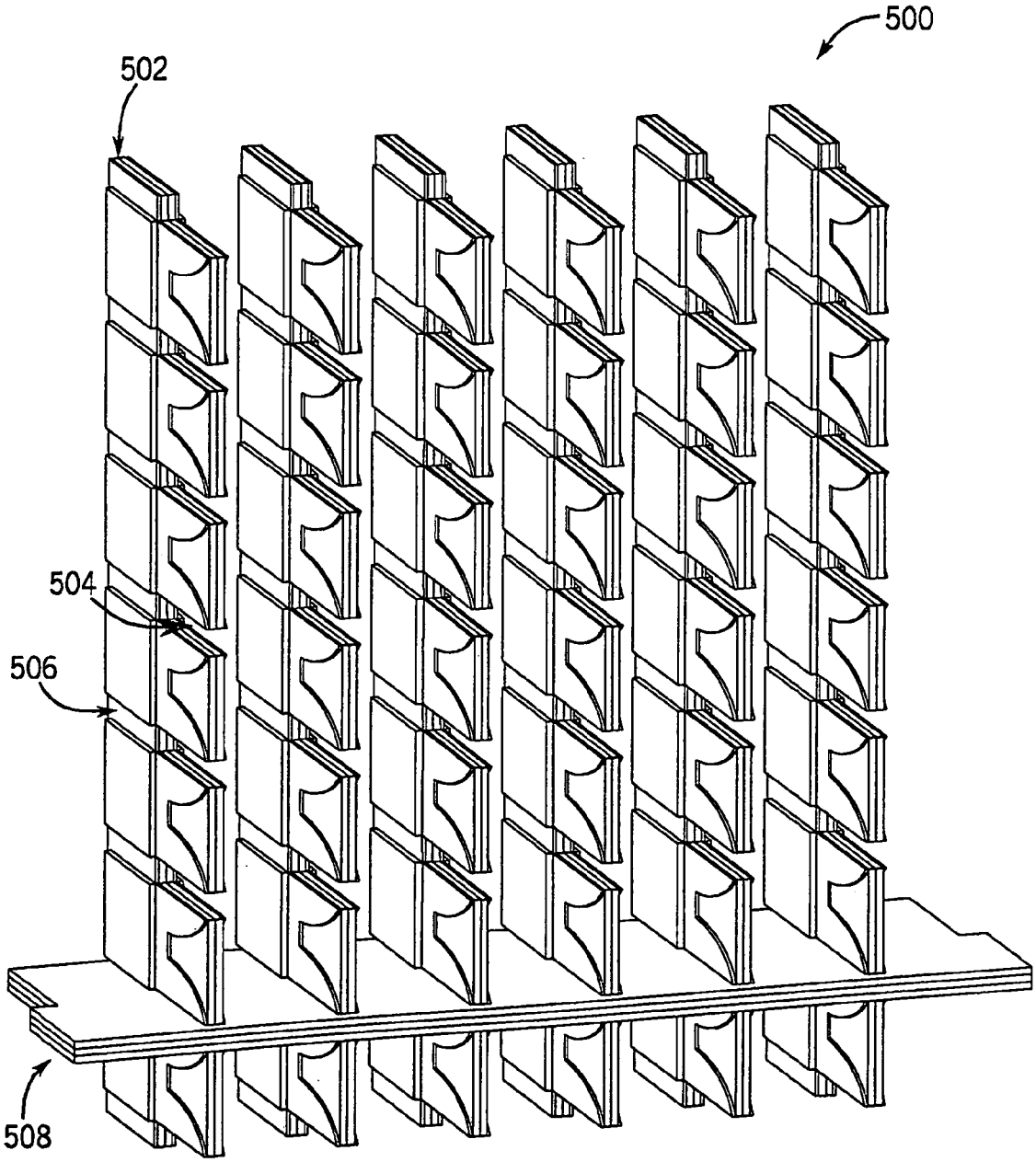
FIG. 5 illustrates a single polarization two dimensional phased array in accordance with an embodiment.

As mentioned above, a two dimensional array may be constructed using a linear array (or slat) of radiating elements as described above with respect to FIGS. 1 2A and 2B as a building block. FIG. 5 illustrates a single polarization two dimensional phased array in accordance with an embodiment. In FIG. 5, multiple linear arrays (or slats) 502 are arranged side by side in phased array 500. Each linear array 502 has its axis in a vertical (column) orientation. Multiple passive horizontal (row) slats 508 are engaged with the active vertical slots 502 using an "egg-crate" like construction. An egg-crate like construction is described generally in U.S. patent application Ser. No. 10/273,872, now U.S. Pat. No. 6,822,617 titled "A Construction Approach for an EMXT-Based Phased Array Antenna," herein incorporated by reference in its entirety. Vertical slats 502 may include slots 504 for engagement with horizontal slats 508. Passive horizontal slats 508 may also be slotted for engagement with the active, vertical slats 502. Passive horizontal slats 508 may be metal or dielectric and typically do not contain circuitry. The orientation of the active and passive slats may be rotated 90 degrees to achieve horizontal polarization.

Grooves 506 between the "islands of circuitry" (described above with respect to FIGS. 2A and 2B) of vertical slat 502 may serve to guide and locate the column slats 502 mating with horizontal slats 508. Solder metal may be applied to specific local areas of the vertical (column) slats 502 and horizontal (row) slats 508 to enable a metallurgical connection where the column and row slats cross. Grooves 506 may also provide a surface to facilitate metallurgical joining (e.g., soldering) of the vertical 502 and horizontal 508 slats. The "rows-by-column" configuration shown in FIG. 5 provides the needed structure for the spacing and positioning of various elements of the phased array 500. In one embodiment, soldering may be used to connect the phase shifter devices to each active vertical slat 502 before construction of the two-dimensional array. Vertical slat(s) 502 may then be soldered to horizontal slat(s) 508 using a lower melting point solder alloy.

Figure 6:
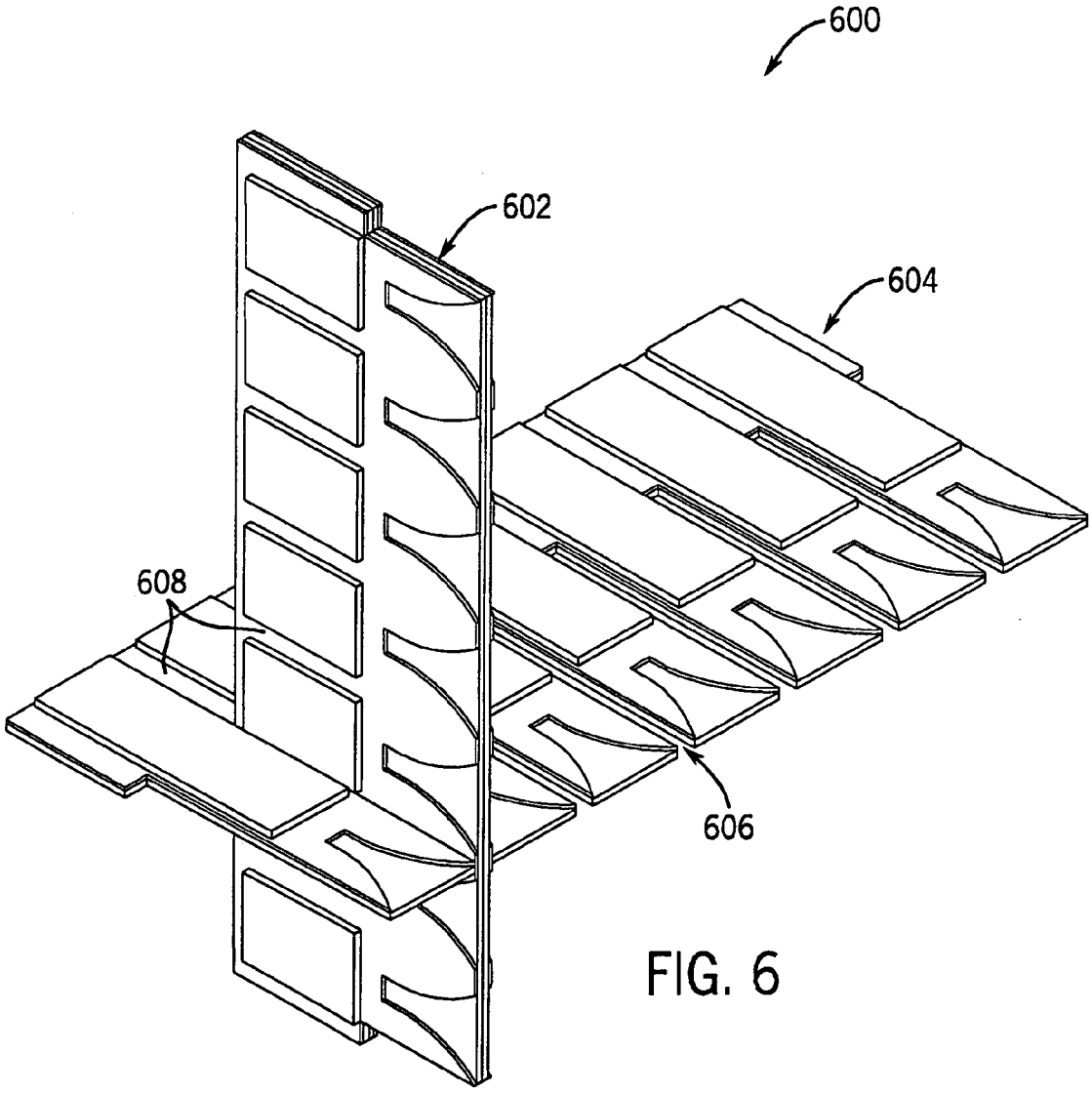
FIG. 6 illustrates a dual polarization two dimensional phased array in accordance with an embodiment.

FIG. 6 illustrates a dual polarization two dimensional phased array 600 in accordance with an embodiment. Active linear array(s) (column) 602 is constructed in a manner similar to that described above with respect to FIGS. 1, 2A and 2B. In the embodiment shown in FIG. 6, vertical slats 602 do not include slots, however, grooves 608 between the "islands of circuitry" on the vertical slats 602 may be used to guide engagement with horizontal slats (rows) 604. Horizontal slats 603 include slots 606 to facilitate engagement with vertical slats 602. Horizontal slats 604 are also active linear array constructed in a manner similar to that described above with respect to FIGS. 1, 2A and 2B. As shown in FIG. 6, one set of slats (e.g., slats 604) is deeper than the other set of slats (e.g., slats 602) to facilitate routing of the embedded circuitry.

As discussed above with respect to FIG. 5, soldering may be used to connect phase shifter devices to the active vertical slats 602 as well as the active horizontal slats 604. Solder metal may also be applied to specific local areas of the active vertical slats 602 and the active horizontal slats 604 to enable a metallurgical connection where the vertical and horizontal slats cross. A constrained feed may be used to feed the active vertical and horizontal slats of phased array 600. For example, for a constrained feed, a feed manifold (not shown), constructed using multilayer printed wiring techniques as described above with respect to FIGS. 1, 2A, and 2B, may be applied to the end of each active vertical slat 602 in an orientation parallel to the horizontal slats 604. Another feed manifold may be applied across the end of each active horizontal slat 604 in an orientation parallel to the active vertical slats 602. Alternatively, a constrained PWB feed directly behind, and perpendicular to, the egg crate slats can be used. For a space feed embodiment, the slats as described above with respect to FIGS. 1, 2A and 2B would be modified as described above with respect to FIG. 4. In particular, the RF stripline feed manifold 110 and RF feed manifold I/O 116 of the linear array (or slat) shown in FIGS. 1, 2A and 2B are removed and RF signals are provided by a space feed (e.g., an RF source coupled to a feed horn). In addition, each radiating element 102 of the linear array is replaced with a radiating element pair 400 as shown in FIG. 4. Bias/control lines 114 are provided in a slat as shown in FIGS. 1, 2A and 2B and include a single locus of electrical connection for bias/control signals.

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The systems and methods depicted and described are not limited to the precise details and conditions disclosed. Furthermore, other substitutions, modifications, changes, and omissions may be made in the design and arrangement of the exemplary embodiments without departing from the scope of the invention as expressed in the appended claims.

What is claimed is:

1. A phased array antenna having a plurality of phase shifter devices for phase shifting and beam steering a radiated beam of the phased array antenna, the plurality of phase shifter devices interconnected with an interconnect structure comprising a plurality of linear array substrate slats, each linear array substrate slat comprising:

a plurality of radiating elements provided using first and second metal layers of the substrate slat;

a common RF feed conductor for the plurality of radiating elements, the common RF feed conductor provided on a third metal layer of the substrate slat, the third metal layer disposed between the first and second metal layers, the common RF feed conductor configured to include a single location for electrical connections to receive RF signals for the plurality of radiating elements;

bias/control conductors for the plurality of phase shifter devices, the bias/control conductors applied to selected areas of the third metal layer and configured to include the single location for electrical connections to receive bias voltages and control signals;

a fourth metal layer applied over the second metal layer, the fourth metal layer including circuit connections from the bias/control conductors to the plurality of phase shifter devices; and a shielding metal layer applied on the fourth metal layer;

wherein each phase shifter device is attached to a radiating element via a mounting location on the shielding metal layer.

2. A phased array antenna according to claim 1, wherein each linear array substrate slat further includes a plurality of radiating element feeds applied to selected areas on the fourth metal layer, each radiating element feed coupling a radiating element to the common RF feed conductor.

3. A phased array antenna according to claim 1, wherein the plurality of linear array substrate slats includes column slats and row slats configured to provide a two-dimensional phased array.

4. A phased array antenna according to claim 3, wherein the column slats are active slats and the row slats are passive slats providing a single polarization two-dimensional array.

5. A phased array antenna according to claim 3, wherein the column slats are active slats and the row slats are active slats providing a dual polarization two dimensional array.

6. A phased array antenna according to claim 1, wherein a plurality of the plurality of phase shifter devices are attached to the plurality of linear array substrate slats by at least one solder connection to corresponding mounting locations.

7. A phased array antenna according to claim 1, wherein a plurality of the plurality of phase shifter devices are attached to the plurality of linear array substrate slat by wirebonding.

8. A phased array antenna according to claim 1, wherein the plurality of radiating elements are end-fire or dipole radiating elements.

9. A phased array antenna according to claim 1, wherein the first, second and third metal layers of the corresponding substrate slat comprise a respective printed wiring board substrate.

10. A phased array antenna according to claim 1, wherein the bias voltages are received from a voltage source and the control signals are received from a beam steering computer coupled to the electrical connections of the corresponding bias/control conductors.

11. A phased array antenna according to claim 1, further including a perimeter constrained RF feed configured to provide the RF signals.

12. A phased array antenna according to claim 1, further including a constrained RF feed located behind and perpendicular to the plurality of linear array substrate slats and configured to provide the RF signals.

13. A phased array antenna according to claim 1, further including a space feed configured to provide the RF signals.

14. A method for a phased array antenna having a plurality of phase shifter devices for phase shifting and beam steering a radiated beam of the phased array antenna, the plurality of phase shifter devices interconnected with an interconnect structure comprising a plurality of linear array substrate slats, the method comprising:

providing a plurality of radiating elements using first and second metal layers of the substrate slat;

providing a common RF feed conductor for the plurality of radiating elements, the common RF feed conductor formed on a third metal layer of the substrate slat, the third metal layer disposed between the first and second metal layers, the common RF feed conductor configured to include a single location for electrical connections to receive RF signals for the plurality of radiating elements;

providing bias/control conductors to selected areas of the third metal layer, the bias/control conductors configured to include the single location for electrical connections to receive bias voltages and control signals;

providing a fourth metal layer over the second metal layer, the fourth metal layer including circuit connections from the bias/control circuitry to the plurality of phase shifter devices;

providing a shielding metal layer on the fourth metal layer; and attaching the plurality of phase shifter devices, each phase shifter device attached to a radiating element via a mounting location on the shielding metal layer.

15. A method according to claim 14, further comprising applying a plurality of radiating element feeds to selected areas on the fourth metal layer.

16. A method according to claim 14 further comprising attaching each of the plurality of phase shifter devices to each of the linear array substrate slats by at least one solder connection to the mounting location.

17. A method according to claim 14, further comprising attaching the plurality of phase shifter devices to each of the linear array substrates by wirebonding.

18. A method according to claim 14, wherein the first, second and third metal layers of the corresponding substrate slat comprise a respective printed wiring board substrate.

19. A method according to claim 14, wherein the plurality of radiating elements are end-fire or dipole radiating elements.

20. A phased array antenna having a plurality of phase shifter means for phase shifting and beam steering a radiated beam of the phased array antenna, the plurality of phase shifter means interconnected with an interconnect structure comprising a plurality of linear array substrate slats, each linear array substrate slat comprising:

a plurality of radiating elements comprised of first and second metal layers of the substrate slat;

a common RF feed means for providing electrical connections for the plurality of radiating elements, the common RF feed means disposed on a third metal layer of the substrate slat, the third metal layer disposed between the first and second metal layers, the common RF feed means configured to receive RF signals for the plurality of radiating elements include at a single location;

bias/control-means for providing electrical connections for the plurality of phase shifter devices, the bias/control means disposed at least partially on the third metal layer and configured to receive bias voltages and control signals at the single location;

a fourth metal layer applied over the second metal layer, the fourth metal layer including circuit connections from the bias/control means to the plurality of phase shifter means; and a shielding metal layer applied on the fourth metal layer;

wherein each phase shifter device is attached to a radiating element via a mounting location on the shielding metal layer.

* * * * *